US005425241A

United States Patent [19]

Agrawal et al.

[11] Patent Number: 5,425,241

[45] Date of Patent: Jun. 20, 1995

[54] PROCESS FOR THE CRYOGENIC DISTILLATION OF AN AIR FEED TO PRODUCE AN ULTRA-HIGH PURITY OXYGEN PRODUCT

[75] Inventors: Rakesh Agrawal, Emmaus; Donald W. Woodward, New Tripoli, both of Pa.

[73] Assignee: Air Products and Chemicals, Inc., Allentown, Pa.

[21] Appl. No.: 241,247

[22] Filed: May 10, 1994

[51] Int. Cl.[6] ..... F25J 3/04

[52] U.S. Cl. ..... 62/22; 62/24

[58] Field of Search ..... 62/21, 24, 37, 22

[56] References Cited

U.S. PATENT DOCUMENTS 5,049,173 9/1991 Cormier et al. ..... 62/24
5,129,932 7/1992 Agrawal et al. ..... 62/22
5,351,492 10/1994 Agrawal et al. ..... 62/24

*Primary Examiner*—Ronald C. Capossela
*Attorney, Agent, or Firm*—Robert J. Wolff

[57] ABSTRACT

A process is set forth for the cryogenic distillation of an air feed to produce an ultra-high purity oxygen product. A first oxygen-containing but heavy contaminants-lean (free) stream is removed from the main distillation column system and subsequently stripped in an auxiliary distillation column. A second oxygen-containing but light contaminants-lean (free) gaseous stream is also removed from the main distillation column system and subsequently fed to the bottom section of the auxiliary distillation column in order to provide heat duty/reboil to the bottom of the auxiliary distillation column. The ultra-high purity oxygen product (ie total contaminant concentration less than 10.0 vppm, preferably less than 1.0 vppm) is withdrawn from an intermediate section of the auxiliary distillation column.

15 Claims, 3 Drawing Sheets

PROCESS FOR THE CRYOGENIC DISTILLATION OF AN AIR FEED TO PRODUCE AN ULTRA-HIGH PURITY OXYGEN PRODUCT

FIELD OF THE INVENTION

The present invention relates to a process for the cryogenic distillation of an air feed to produce an ultra-high purity oxygen product wherein an oxygen-containing but heavy contaminants-lean (free) stream is removed from the main distillation column system and subsequently stripped in an auxiliary distillation column.

BACKGROUND OF THE INVENTION

A process for the cryogenic distillation of an air feed to produce an ultra-high purity oxygen product wherein an oxygen-containing but heavy contaminants-lean (free) stream is removed from the main distillation column system and subsequently stripped in an auxiliary distillation column is taught in the art. Specifically, U.S. Pat. No. 5,049,173 by Cormier et al. teaches such a process. A key feature in Cormier is the method of providing heat duty/reboil to the bottom of the auxiliary distillation column. Where the main distillation column system in Cormier comprises a single distillation column, Cormier's method of providing heat duty/reboil to the bottom of the auxiliary distillation column consists of partially condensing a portion of the gaseous nitrogen overhead. On the other hand, where the main distillation column system in Cormier comprises the classical high pressure/low pressure column arrangement, Cormier's heat duty method consists of at least partially condensing a portion of the "intermediate" gaseous nitrogen overhead from the high pressure column and/or subcooling a portion of the "intermediate" liquid oxygen bottoms from the high pressure column. There is a concern with Cormier, however, in that such methods may not be the most efficient way of providing heat duty/reboil to the bottom of the auxiliary distillation column. It is an object of the present invention to more efficiently provide heat duty/reboil to the bottom of the auxiliary distillation column and thereby more efficiently produce the ultra-high purity oxygen product.

SUMMARY OF THE INVENTION

The present invention is a process for the cryogenic distillation of an air feed to produce an ultra-high purity oxygen product. A first oxygen-containing but heavy contaminants-lean (free) stream is removed from the main distillation column system and subsequently stripped in an auxiliary distillation column. A second oxygen-containing but light contaminants-lean (free) gaseous stream is also removed from the main distillation column system and subsequently fed to the bottom section of the auxiliary distillation column in order to provide heat duty/reboil to the bottom of the auxiliary distillation column. The ultra-high purity oxygen product (ie total contaminant concentration less than 10.0 vppm, preferably less than 1.0 vppm) is withdrawn from an intermediate section of the auxiliary distillation column.

DETAILED DESCRIPTION OF THE INVENTION

The present invention is a process for the cryogenic distillation of an air feed to produce an ultra-high purity oxygen product using a main distillation column system and an auxiliary distillation column comprising.

(a) feeding to the main distillation column at least a portion of the air feed which has been compressed to an elevated pressure, cleaned of impurities which will freeze out at cryogenic temperatures and cooled to near its dew point;

(b) rectifying the air feed into a final gaseous nitrogen overhead and a final liquid oxygen bottoms;

(c) removing a first oxygen-containing stream from a location of the main distillation column system where the removed stream is essentially free of heavier contaminants comprising hydrocarbons, carbon dioxide, xenon and krypton;

(d) feeding the first oxygen-containing stream to the top section of an auxiliary distillation column in order to strip the first oxygen-containing stream;

(e) removing a second oxygen-containing stream from a location of the main distillation column system where the removed stream is a gaseous stream essentially free of lighter contaminants comprising hydrogen, helium, neon, nitrogen and argon;

(f) feeding the second oxygen-containing stream to the bottom section of the auxiliary distillation column in order to provide heat duty/reboil to the bottom of the auxiliary distillation column; and (g) withdrawing the ultra-high purity oxygen product from an intermediate section of the auxiliary distillation column.

In one embodiment of the present invention, all heat duty/reboil to the bottom of the auxiliary distillation column is provided by feeding the second oxygen-containing stream to the bottom section of the auxiliary distillation column. Optionally, heat duty/reboil to the bottom of the auxiliary distillation column can also be provided by the methods taught in Cormier as discussed supra.

The process of the present invention is best illustrated with reference to specific embodiments thereof such as the embodiments depicted in FIGS. 1, 2 and 3.

Figure 1:
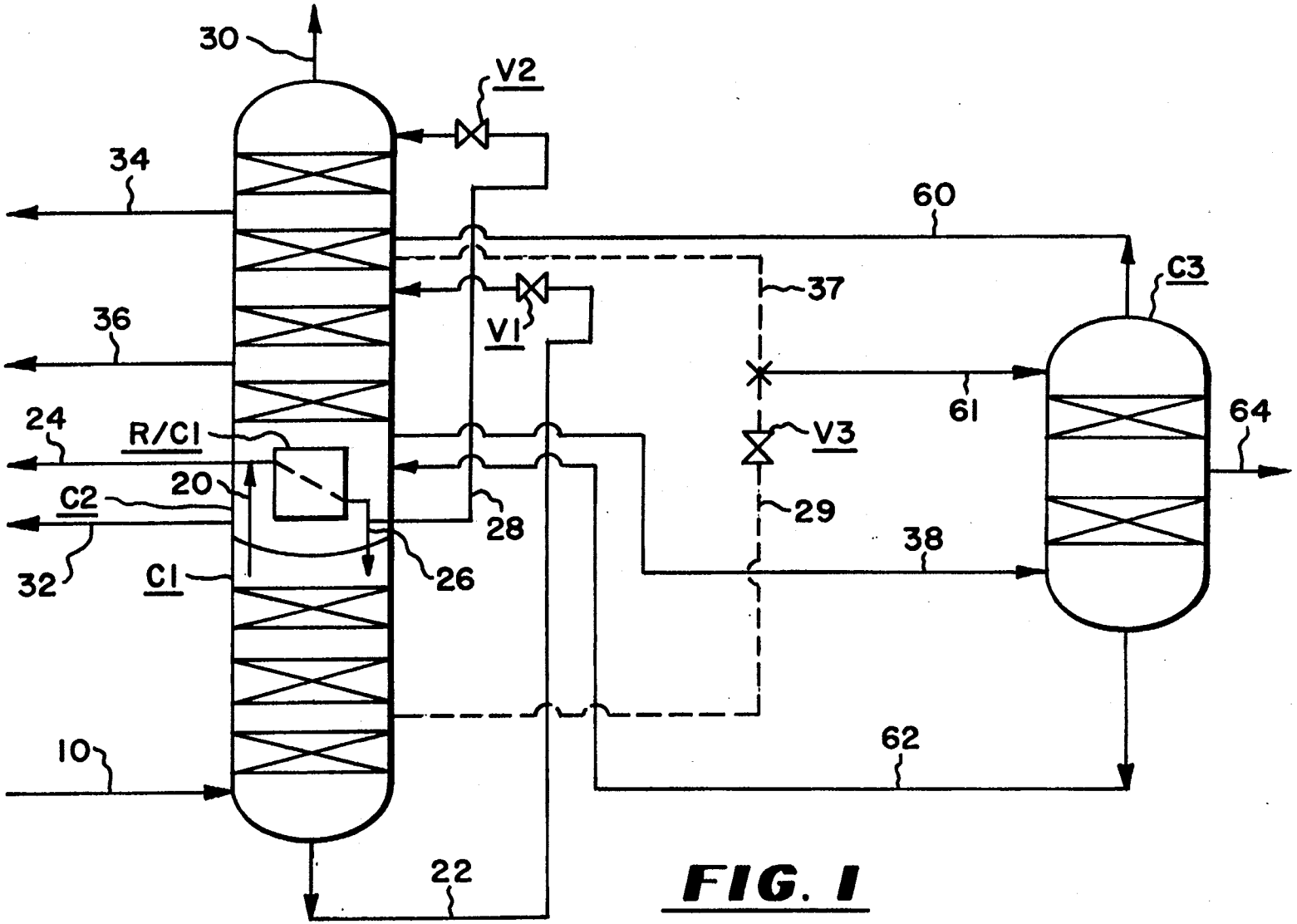
FIG. 1 is a schematic diagram of a first embodiment of the present invention.

Referring now to FIG. 1, an air feed (stream 10) which has been compressed to an elevated pressure, cleaned of impurities which will freeze out at cryogenic temperatures and cooled to near its dew point is fed to the main distillation column system. The compression of the feed stream is typically performed in multiple stages with interstage cooling against cooling water. The cleaning of impurities which will freeze out at cryogenic temperatures (such as water and carbon dioxide) is typically performed by a process which incorporates an adsorption mole sieve bed. The cooling of the air feed down to its dewpoint is typically performed by heat exchanging the pressurized air feed in a front end main heat exchanger against the gaseous product streams which are produced from the process at cryogenic temperatures.

In FIG. 1, the main distillation column system comprises the classical high pressure/low pressure column arrangement. The air feed is fed to high pressure column C1 in which the air feed is rectified into an intermediate gaseous nitrogen overhead (stream 20) and an intermediate liquid oxygen bottoms (stream 22). A portion of the intermediate gaseous nitrogen overhead is removed as a product stream (stream 24). The intermediate liquid oxygen bottoms is reduced in pressure across valve V1 and fed to low pressure column C2 in which it is distilled into a final gaseous nitrogen overhead (stream 30) and the final liquid oxygen bottoms, a portion of which is removed as a normal purity (ie total contaminant concentration generally less than 0.5%) liquid oxygen product stream (stream 32). A waste stream (stream 34) and a normal purity (again, total contaminant concentration generally less than 0.5%) gaseous oxygen product stream (stream 36) are also removed from the low pressure column.

The high pressure and low pressure columns are thermally integrated in that a portion of the intermediate gaseous nitrogen overhead from the high pressure column is condensed in reboiler/condenser R/C 1 against a vaporizing oxygen-rich liquid from the low pressure column. Typically, as is the case in FIG. 1, this low pressure column oxygen-rich liquid will consist of the final liquid oxygen bottoms which collects in the sump of the low pressure column. A first portion of the condensed intermediate gaseous nitrogen overhead (stream 26) is used to provide reflux for the high pressure column while a second portion (stream 28) is used to provide reflux for the low pressure column after being reduced in pressure across valve V2.

A first oxygen-containing stream (stream 61) is removed from a location of the main distillation column system where the removed stream is essentially free of heavier contaminants comprising hydrocarbons, carbon dioxide, xenon and krypton. As represented by the dotted lines in FIG. 1, this first oxygen-containing stream to be stripped in the auxiliary distillation column can be removed from the high pressure column (stream 29) and/or the low pressure column (stream 37). Furthermore, the removed stream(s) from either column can be withdrawn as liquid, vapor or a combination of both. If removed from the high pressure column, the first oxygen-containing stream is typically withdrawn several stages above the air feed location. If removed from the low pressure column, the first oxygen-containing stream is typically withdrawn several stages above the intermediate liquid oxygen bottoms feed location. Regardless of which column the first oxygen-containing stream is removed from, its typical oxygen concentration is between 5% and 25% if removed as a liquid and between 3% and 15% if removed as a vapor.

The first oxygen-containing stream is subsequently fed to the top of auxiliary distillation column C3 in order to strip the first oxygen-containing stream. As shown in FIG. 1, any portion of the first oxygen-containing stream which is removed from the high pressure column is reduced in pressure across valve V3 prior to being fed to the auxiliary distillation column.

A second oxygen-containing stream (stream 38) is removed from a location of the main distillation column system where the removed stream is a gaseous stream essentially free of lighter contaminants comprising hydrogen, helium, neon, nitrogen and argon. As shown in FIG. 1, this second oxygen-containing gaseous stream typically is removed from a location at or near the bottom of the low pressure column. Besides containing heavy Contaminants, the second oxygen-containing stream should only contain oxygen and this oxygen concentration should be greater than 90% and preferably greater than 99.5%. The second oxygen-containing gaseous stream is fed to the bottom section of the auxiliary column in order to provide heat duty/reboil to the bottom of the auxiliary column. Both the overhead stream (stream 60) and the bottom stream (stream 62) from the auxiliary column are returned to a suitable location in the low pressure column (ie a location where the composition in the column is similar to the composition of the streams being returned). The ultra-high purity oxygen product (stream 64) is withdrawn from an intermediate section of the auxiliary column.

In FIG. 1, the amount of refrigeration needed to complete the heat balance for the process will depend on, among other factors, the product mix between liquid and gaseous products. If additional refrigeration is needed to complete the heat balance, a portion of the air feed can be expanded in an expander and subsequently fed to a suitable location in the low pressure column. Also, where the first oxygen-containing stream comprises vapor removed from the high pressure column, such vapor can be expanded in an expander prior to being stripped in the auxiliary column.

Also in FIG. 1, it should be noted that the auxiliary column can be refluxed with any nitrogen-rich but heavy contaminants-lean (free) liquid stream from the main distillation column system such as a portion of the condensed intermediate nitrogen overhead from the high pressure column that has been reduced in pressure across a valve. In such a case, the first oxygen-containing stream would be fed to the auxiliary column at least one stage below the top stage of the auxiliary column.

Figure 2:
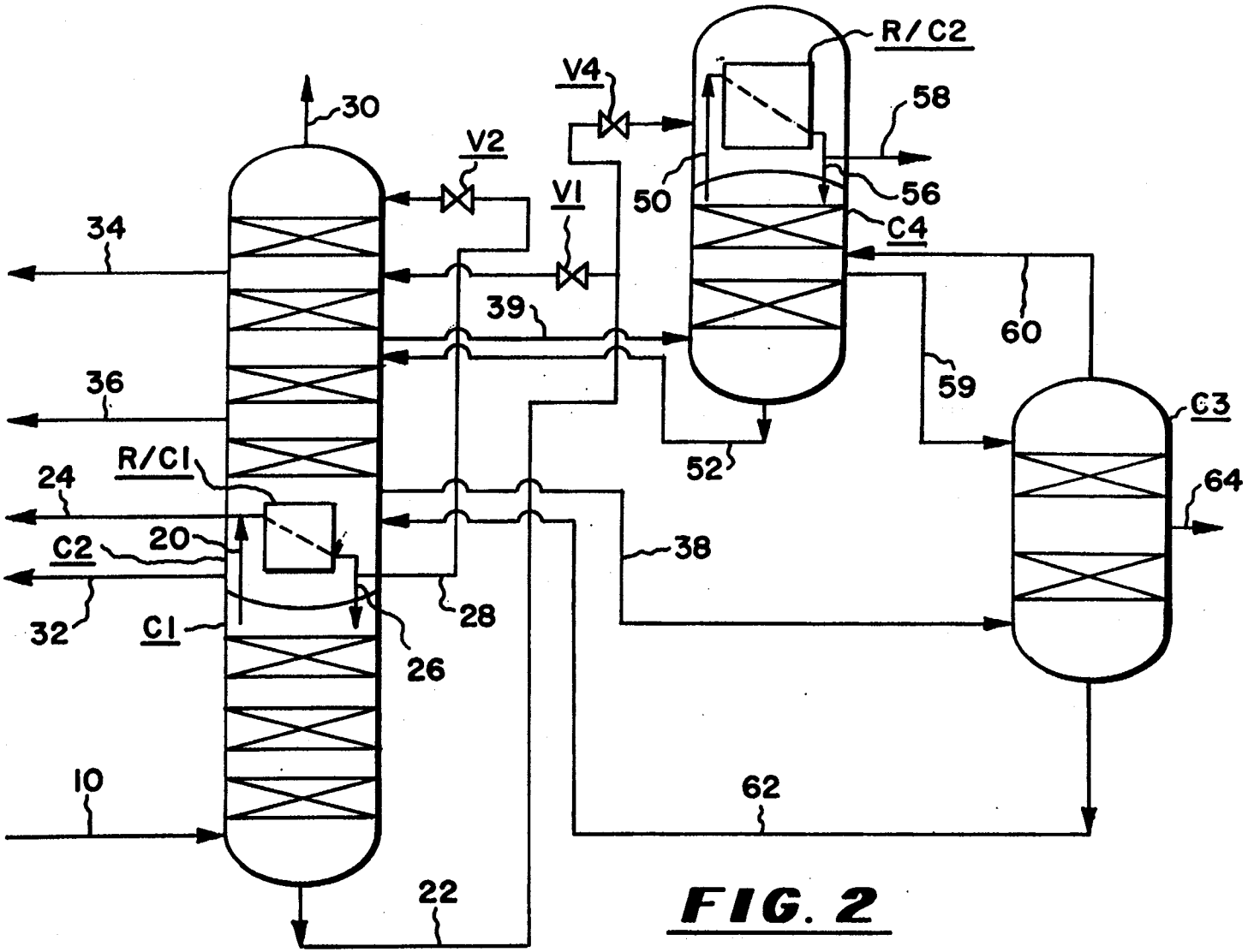
FIG. 2 is a schematic diagram of a second embodiment of the present invention.

The process of FIGS. 2 is similar to FIG. 1 (common streams and equipment are identified by the same number) except that:

(i) the main distillation column system further comprises argon side-arm column C4;

(ii) an argon-containing gaseous side stream (stream 39) is removed from the low pressure column and fed to the argon side-arm column in which the argon-containing gaseous side stream is rectified into an argon-rich gaseous overhead (stream 50) and an argon-lean bottoms liquid (stream 52). The argon-lean bottoms liquid is returned to a suitable location in the low pressure column. The argon-rich gaseous overhead is condensed in reboiler/condenser R/C 2 against a portion of the intermediate liquid oxygen bottoms which has been reduced in pressure across valve V4. A first portion of the condensed argon-rich overhead is returned as reflux to the argon side-arm column (stream 56) while a second portion is removed as a liquid argon product stream (stream 58);

(iii) the first oxygen-containing stream to be stripped in the auxiliary distillation column is removed from the argon side-arm column (stream 59) as liquid, vapor or a combination of both; and (iv) the overhead from the auxiliary distillation column (stream 60) is returned to a suitable location in the argon side-arm column (as shown in FIG. 2) or the low pressure column.

Where the first oxygen-containing stream to be stripped in the auxiliary distillation column is removed from the argon side-arm column as per FIG. 2, its typical oxygen concentration is between 5% and 90%.

Figure 3:
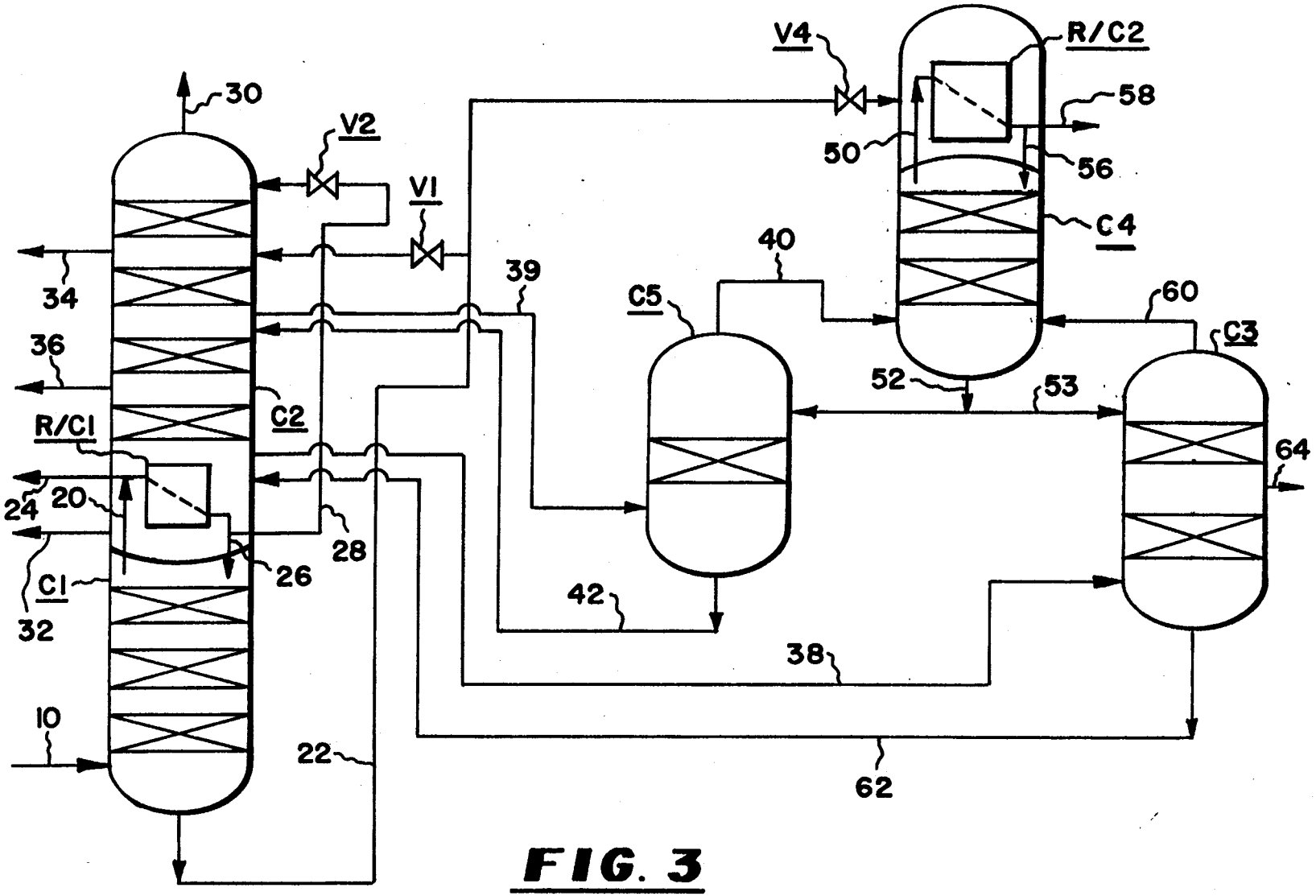
FIG. 3 is a schematic diagram of a third embodiment of the present invention.

The process of FIGS. 3 is similar to FIG. 2 (common streams and equipment are identified by the same number) except that:

(i) prior to feeding the argon-containing side stream (stream 39) to the argon side-arm column, such stream is rectified in column C5 to remove heavier contaminants comprising hydrocarbons, carbon dioxide, xenon and krypton. The overhead stream from column C5 (stream 40) is fed to a suitable location in the argon side-arm column while the bottom stream from column C5 (stream 42) is returned to a suitable location in the low pressure column; and (ii) the first oxygen-containing stream to be stripped in the auxiliary distillation column consists of a portion of the argon-lean bottoms liquid (stream 53).

In FIG. 3, it should be noted that the auxiliary distillation column and the argon side-arm column can easily be consolidated such that the auxiliary distillation column constitutes the stripping section of the consolidated column while the argon side-arm column constitutes the enriching section of the consolidated column.

Computer simulations of the present invention have demonstrated that 59.7% of the oxygen in the air feed can be recovered as the ultra-high purity oxygen product in stream 64 while an additional 32.3% of the oxygen in the air feed can be recovered as the normal purity oxygen product in stream 36. This represents a total oxygen recovery of 92.0%. These recoveries are a substantial increase over the prior art. For example, if heat duty/reboil to the bottom of the auxiliary distillation column is provided by the methods taught in Cormier as discussed supra, only about 19% of the oxygen in the air feed is recovered as the ultra-high purity oxygen product.

The present invention has been described with reference to three specific embodiments thereof. These embodiments should not be seen as a limitation of the scope of the present invention; the scope of such being ascertained by the following claims.

We claim:

1. A process for the cryogenic distillation of an air feed to produce an ultra-high purity oxygen product using a main distillation column system and an auxiliary distillation column comprising the steps of:

(a) feeding to the main distillation column at least a portion of the air feed which has been compressed to an elevated pressure, cleaned of impurities which will freeze out at cryogenic temperatures and cooled to near its dew point;

(b) rectifying the air feed into a final gaseous nitrogen overhead and a final liquid oxygen bottoms;

(c) removing a first oxygen-containing stream from a location of the main distillation column system where the removed stream is essentially free of heavier contaminants comprising hydrocarbons, carbon dioxide, xenon and krypton;

(d) feeding the first oxygen-containing stream to the top section of an auxiliary distillation column in order to strip the first oxygen-containing stream;

(e) removing a second oxygen-containing stream from a location of the main distillation column system where the removed stream is a gaseous stream essentially free of lighter contaminants comprising hydrogen, helium, neon, nitrogen and argon;

(f) feeding the second oxygen-containing stream to the bottom section of the auxiliary distillation column in order to provide heat duty/reboil to the bottom of the auxiliary distillation column; and (g) withdrawing the ultra-high purity oxygen product from an intermediate section of the auxiliary distillation column.

2. The process of claim 1 wherein all heat duty/reboil to the bottom of the auxiliary distillation column is provided by feeding the second oxygen-containing stream to the bottom section of the auxiliary distillation column.

3. The process of claim 2 wherein the ultra-high purity oxygen product withdrawn in step (g) is withdrawn as liquid, vapor or a combination of both and has a total contaminant concentration less than 10.0 vppm, preferably less than 1.0 vppm.

4. The process of claim 3 wherein a normal purity oxygen product stream having a total contaminant concentration less than 0.5% is also removed from the main distillation column system.

5. The process of claim 1 wherein heat duty/reboil to the bottom of the auxiliary distillation column is also provided by at least partially condensing a portion of the final gaseous nitrogen overhead.

6. The process of claim 1 wherein:

(i) the main distillation column system comprises a high pressure column and a low pressure column;

(ii) the compressed, cleaned and cooled air feed is specifically fed to the high pressure column in which the air feed is rectified into an intermediate gaseous nitrogen overhead and an intermediate liquid oxygen bottoms;

(iii) at least a portion of the intermediate liquid oxygen bottoms is fed to the low pressure column in which the intermediate liquid oxygen bottoms is distilled into the final gaseous nitrogen overhead and the final liquid oxygen bottoms;

(iv) the high pressure and low pressure columns are thermally integrated such that a first portion of the intermediate gaseous nitrogen overhead is condensed in a first reboiler/condenser against a vaporizing low pressure column oxygen-rich liquid; and (v) at least a portion of the condensed intermediate gaseous nitrogen overhead is used to provide reflux for the high pressure column and/or low pressure column.

7. The process of claim 6 wherein all heat duty/reboil to the bottom of the auxiliary column is provided by feeding the second oxygen-containing stream to the bottom section of the auxiliary column.

8. The process of claim 7 wherein the ultra-high purity oxygen product withdrawn in step (g) is withdrawn as liquid, vapor or a combination of both and has a total contaminant concentration less than 10.0 vppm, preferably less than 1.0 vppm.

9. The process of claim 8 wherein a normal purity oxygen product stream having a total contaminant concentration less than 0.5% is also removed from the low pressure column.

10. The process of claim 9 wherein the second oxygen-containing stream which is fed to the bottom of the auxiliary column in step (f) consists of a gaseous stream removed at or near the bottom of the low pressure column having an oxygen concentration greater than 99.5%.

11. The process of claim 10 wherein the first oxygen-containing stream which is stripped in the auxiliary distillation column in step (d) consists of one or more streams selected from the group consisting of:

(i) a liquid stream removed from the high pressure column having an oxygen concentration between 5% and 25%;

(ii) a gaseous stream removed from the high pressure column having an oxygen concentration between 3% and 15%;

(iii) a liquid stream removed from the low pressure column having an oxygen concentration between 5% and 25%; and (iv) a gaseous stream removed from the low pressure column having an oxygen concentration between 3% and 15%.

12. The process of claim 10 wherein:

(i) the main distillation column system further comprises a argon side-arm column;

(ii) an argon-containing gaseous side stream is removed from the low pressure column and fed to the argon side-arm column in which the argon-containing gaseous side stream is rectified into an argon-rich gaseous overhead and an argon-lean bottoms liquid; and (iii) at least a portion of the argon-lean bottoms liquid is returned to the low pressure column.

13. The process of claim 12 wherein the first oxygen-containing stream which is stripped in the auxiliary distillation column in step (d) is removed from the argon side-arm column as liquid, vapor or a combination of both and has an oxygen concentration between 5% and 90%.

14. The process of claim 12 wherein:

(i) prior to feeding the argon-containing side stream to the argon side-arm column, the argon-containing side stream is rectified to remove heavier contaminants comprising hydrocarbons, carbon dioxide, xenon and krypton; and (ii) the first oxygen-containing stream which is stripped in the auxiliary distillation column in step (d) consists of a portion of the argon-lean bottoms liquid.

15. The process of claim 6 wherein heat duty/reboil to the bottom of the auxiliary column is also provided by at least partially condensing a second portion of the intermediate gaseous nitrogen overhead and/or subcooling a portion of the intermediate liquid oxygen bottoms.

* * * * *